United States Patent [19]

Pagel

[11] Patent Number: 4,484,863

[45] Date of Patent: Nov. 27, 1984

[54] ROTARY VANE PUMP WITH UNDERVANE PUMPING AND AN AUXILIARY OUTLET

[75] Inventor: Wayne H. Pagel, Minneapolis, Minn.

[73] Assignee: Hydraulic Services Inc., Minneapolis, Minn.

[21] Appl. No.: 273,221

[22] Filed: Oct. 5, 1981

[51] Int. Cl.[3] ..... F04B 23/10; F04C 2/00; F04C 15/00

[52] U.S. Cl. ..... 417/204; 417/206; 418/133; 418/135; 418/268

[58] Field of Search ..... 417/204, 206; 418/15, 418/133, 82, 13, 135, 268

[56] References Cited

U.S. PATENT DOCUMENTS

| | | | |
|---|---|---|---|
| 1,468,889 | 9/1923 | Trotter | 418/13 |
| 2,544,987 | 3/1951 | Gardiner et al. | 418/133 |
| 2,544,988 | 3/1951 | Gardiner et al. | 418/133 |
| 2,544,990 | 3/1951 | Harrington et al. | 418/133 |
| 2,642,802 | 6/1953 | Gardiner | 418/133 |
| 2,910,944 | 11/1959 | Pettibone | 417/204 |
| 3,007,419 | 11/1961 | Burt | 418/77 |
| 3,081,706 | 3/1963 | Drutchas et al. | 417/204 |
| 3,402,891 | 9/1968 | Clark et al. | 417/204 |
| 3,822,965 | 7/1974 | Drutchas et al. | 418/133 |
| 3,973,881 | 8/1976 | Melchinger | 418/81 |

FOREIGN PATENT DOCUMENTS

| | | | |
|---|---|---|---|
| 2744591 | 4/1979 | Fed. Rep. of Germany | 417/204 |

*Primary Examiner*—John J. Vrablik

[57] ABSTRACT

A rotary vane pump having a rotatable rotor in an elliptical chamber and a plurality of radially slidable vanes dispersed around the rotor, and having an intake phase and a discharge phase of rotor rotation, wherein liquid is admitted into the pump, pressurized and expelled from the pump at an elevated pressure. The improvement including passages in flow communication with the pressurized side of the pump vanes, and an auxiliary outlet communicating with the passages to provide an auxiliary pressurized liquid outlet from the pump, wherein the auxiliary pressure is developed by the pump vanes.

6 Claims, 8 Drawing Figures

ROTARY VANE PUMP WITH UNDERVANE PUMPING AND AN AUXILIARY OUTLET

BACKGROUND OF THE INVENTION

The present invention relates to rotary vane pumps, and more particularly to improvements in rotary vane pumps whereby an auxiliary pressure outlet may be provided.

Rotary vane pumps are generally known in the prior art. For example, U.S. Pat. No. 2,544,987, issued Mar. 13, 1951, describes a rotary vane pump of the type generally applicable to the present invention having intake and discharge passages interspersed at approximately 90° intervals about the path of rotation of a rotor. U.S. Pat. No. 2,544,988, issued Mar. 13, 1951 discloses a rotary vane pump having a floating cheek plate and utilizing liquid pressure from the discharge side of the pump against the cheek plate to adjust the clearance between the rotor and vane surfaces and the cheek plate. According to the teachings of this patent the intake passages to the pump are located completely on one side of the rotor of the pumping unit while the discharge passages are completely on the other side of the rotor. The cheek plate is provided with a dual function, providing liquid distributing ports in connecting the discharge side of the pumping unit to the outlet and also directing liquid pressure to the discharge chamber. U.S. Pat. No. 3,007,419, issued Nov. 7, 1961, discloses a rotary vane pump having an accumulator reservoir maintained at a pressure approaching the pump discharge pressure, and valve means operated in phase relation with the pump rotor to bleed small amounts of liquid out of the pump's discharge in a manner to offset pulsations caused by the pump.

U.S. Pat. No. 1,468,889, issued Sept. 25, 1923, discloses a multistage rotary pump having two concentric ported cylinders and an eccentric rotor or rotating member. This patent discloses a plurality of radial vanes confined between two concentric cylinders in a rotor which is eccentrically mounted relative to the cylinders. As the rotor is rotated the vanes are also rotated within the confines of the two concentric cylinders, and the eccentric motion of the rotor creates a relative reciprocation between the rotor and the vanes, so as to provide an inner and outer series of expansible chambers. Passages may interconnect the inner and outer ported cylinders to develop a multistage pumping effect, or liquid may be delivered from the first stage to a comparatively low pressure and from the second stage at a higher pressure. Dual pressure operation is therefore achieved by driving an eccentric rotor within two concentric chambers, and providing complex interrelating passages.

There is a need to provide a pump of relatively simple construction wherein two separate liquid pressures may be delivered from a single pump, particularly where the secondary pump output pressure is independent of the primary pump output pressure. It is preferable to provide such a pump with as simple a design as possible in order that the costs of providing two such pressures may be significantly lower than the cost of merely providing two pumps operating at different pressures and coupled into the same flow system.

SUMMARY OF THE INVENTION

The invention comprises a novel utilization of operating principles of conventional rotary vane pumps, and specifically utilization of the pumping effects of the individual vanes within a rotary vane pump, to develop an auxiliary pump output pressure. As the rotor of a rotary vane pump rotates the vanes within the rotor follow the surface contour of an eccentric outer chamber surrounding the rotor, and therefore the vanes slide radially in and out of the rotor slots. Each vane, within its radial slot, functions as a small piston pump, creating an intake at its inner radius point as the vane slides outwardly and creating a discharge pressure at its inner radius point as the vane slides inwardly. In conventional rotary vane pumps passages are provided between the pump discharge chamber and the inner vane ends during the pump intake phase to develop pressure forces against the inner vane ends, and to thereby force the vanes outwardly against the eccentric chamber wall within which the rotor rotates. These pressure forces assist in maintaining an oil tight seal between the eccentric chamber surface and the ends of the respective vanes. Conventional rotary vane pumps bleed off this pressure during the pump discharge phase through passages feeding into the pressure discharge chamber of the pump.

The present invention utilizes the pressurized liquid developed by the vanes during their radial inward movement, by coupling this pressurized liquid through independent passages to an auxiliary outlet from the pump, and thereby to provide an auxiliary pressurized liquid outlet for the pump.

BRIEF DESCRIPTION OF THE DRAWINGS

An understanding of the scope and advantages of the present invention will become apparent from the following specification, and with reference to the appended drawings, in which.

DESCRIPTION OF THE PREFERRED EMBODIMENT

Figure 1:
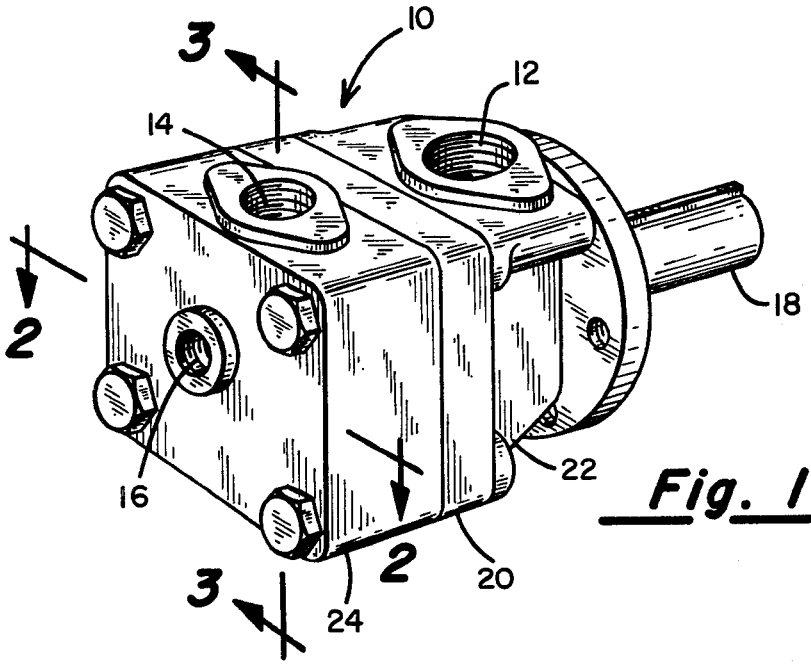
FIG. 1 shows an isometric view of the invention.

Referring first to FIG. 1 there is shown a rotary vane pump 10 incorporating the present invention. Pump 10 is comprised of an intake chamber casting 22, a pumping chamber casting 20, and a discharge chamber casting 24, all of which are secured together by bolts or other fasteners. A drive shaft 18 projects from casting 22, and is preferably retained on ball bearings within casting 22. An inlet 12 is tapped into casting 22 and is adaptable for connection to a source of inlet liquid. A primary outlet 14 passes through casing 24 and is adaptable for connection to an external pressurized flow communication path. A secondary outlet 16 passes through casting 24 and is adaptable for connection to a secondary pressurized flow communication path.

Figure 2:
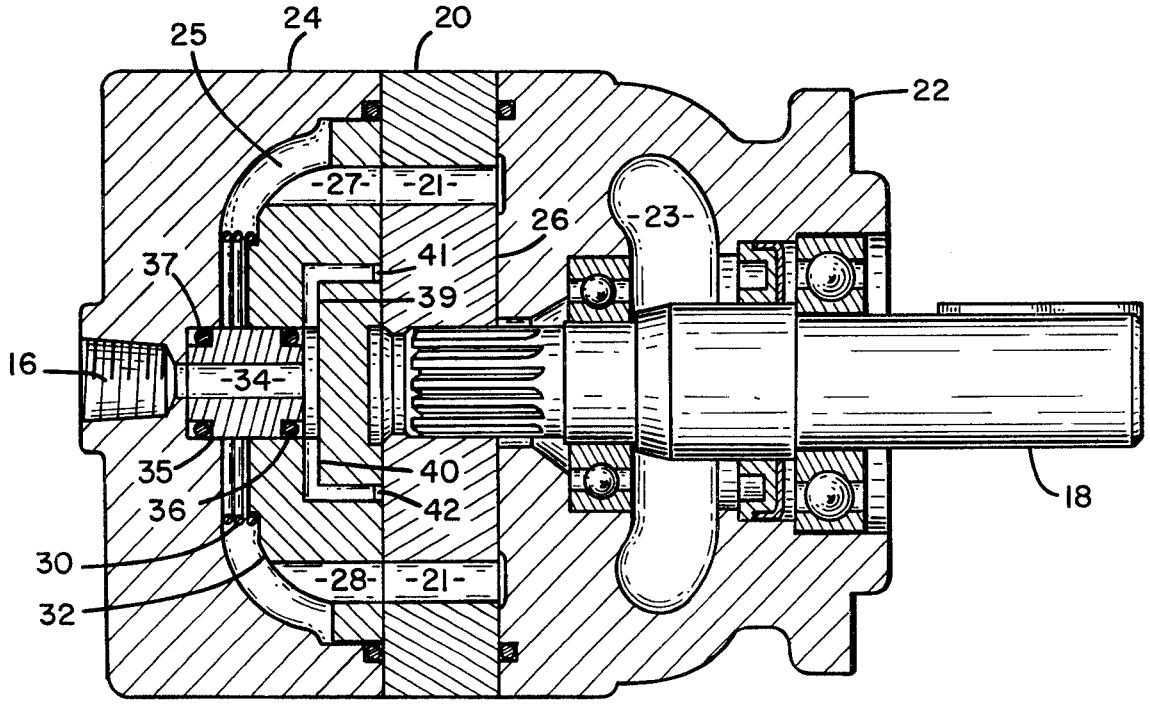
FIG. 2 shows the invention in cross section, taken along the lines 2—2 of FIG. 1.

Referring next to FIG. 2, there is shown a cross-sectional view taken along the lines 2—2 of FIG. 1. Shaft 18 passes through bearings seated in casting 22, the end of shaft 18 being formed into a splined end which is slidably securely attached to rotor 26. Rotor 26 is positioned in pumping chamber 21, which is an eccentrically shaped chamber. An intake chamber 23 is in flow communication with inlet 12.

A pressure plate, or cheek plate 32 closes one end of pumping chamber 21. Passages through pressure plate 32 create a flow communication path between pumping chamber 21 and primary discharge chamber 25. A secondary discharge chamber 34 is created within a tube 35, the ends of which are seated respectively into casting 24 and pressure plate 32. Liquid sealing O-rings 36 and 37 seal the respective ends of tube 35 from leakage. A compression spring 30 is seated between casting 24 and pressure plate 32, and serves to urge pressure plate 32 toward casting 20 and rotor 26. Compression spring 30 serves to improve the liquid seal between pressure plate 32 and casting 20 and rotor 26.

The primary discharge chamber 25 communicates with pumping chamber 21 via passages 27 and 28 through pressure plate 32. Secondary discharge chamber 34 is in flow communication with passages 39 and 40, which open into grooves 41 and 42 on the face of pressure plate 32. Secondary discharge chamber 34 is also in flow communication with secondary outlet 16.

Figure 3:
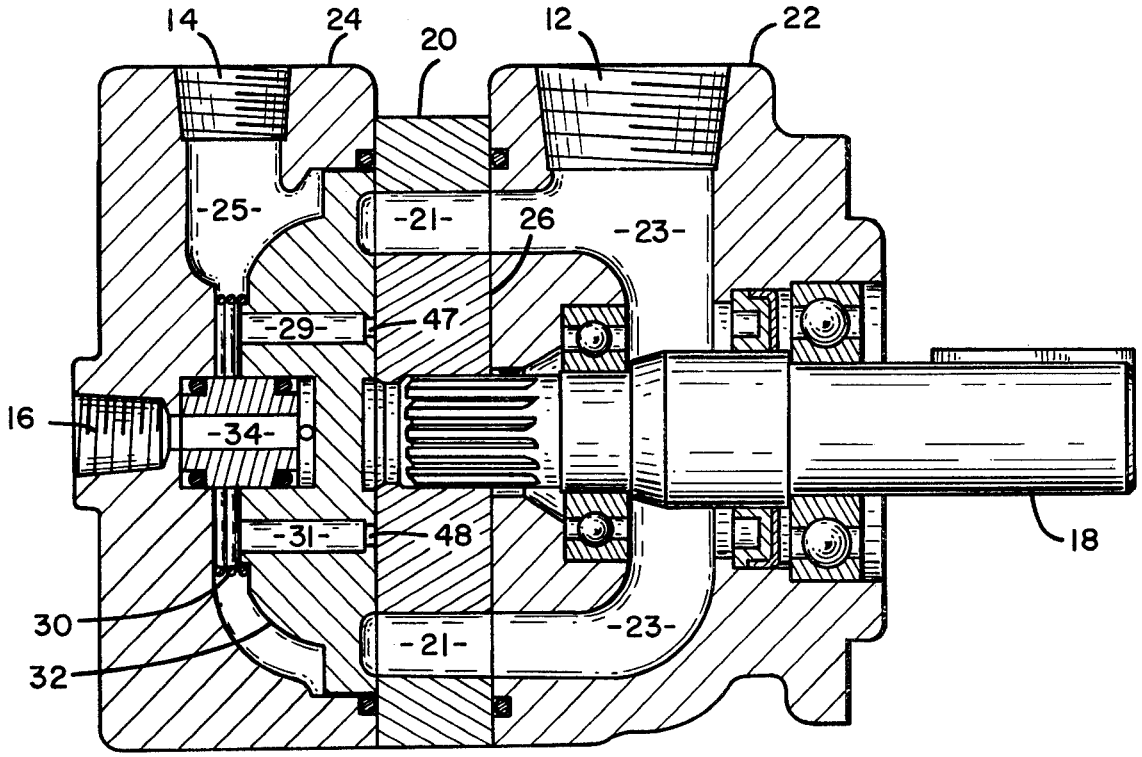
FIG. 3 shows a cross-sectional view of the invention taken along the lines 3—3 of FIG. 1.

FIG. 3 shows a cross-sectional view taken along lines 3—3 of FIG. 1. Intake chamber 23 is in flow communication with inlet 12, and also is in flow communication with pumping chamber 21. Discharge chamber 25 is in flow communication with primary outlet 14. Discharge chamber 25 is also in flow communication with the inner radius of some of the rotor vanes through passages 29 and 31, which open through pressure plate 32 into grooves 47 and 48 respectively. Grooves 47 and 48 are arcuate grooves which are in flow communication with the inner radii of a plurality of rotor vane slots, and liquid flow through this path pressurizes the rotor vane slots in flow communication therewith, thereby creating pressure forces which tend to urge the vanes outwardly in sealing contact against the inner surface contour of pumping chamber 21.

The elliptical shape of pumping chamber 21 can be noted from a comparison of FIGS. 2 and 3. In FIG. 3, pumping chamber 21 is shown as a relatively large and open chamber, corresponding generally to the late intake or early pressure discharge phases of rotor rotation. By comparison, FIG. 2 shows vane chamber 21 as a relatively small chamber, corresponding generally to the late pressure or early intake phases of rotor rotation. Specifically, FIG. 3 shows a cross-sectional view corresponding to the position of rotor 26 at or near the end of an intake phase of its rotation; FIG. 2 shows a cross-sectional view of rotor 26 at or near the end of a pressure discharge phase of rotation.

Figure 6A:
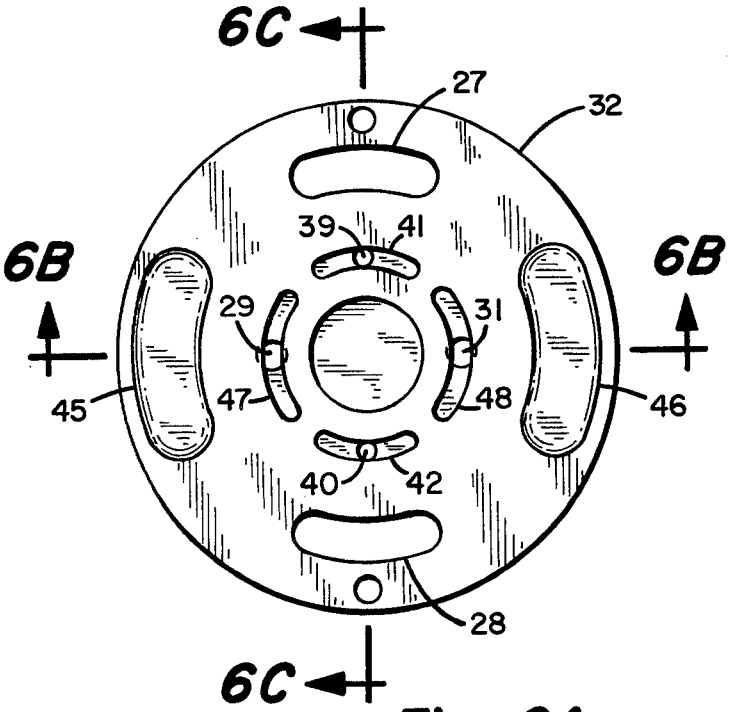
FIG. 6A shows a pressure plate utilized in a rotary vane pump according to the teachings of the invention.
Figure 6C:
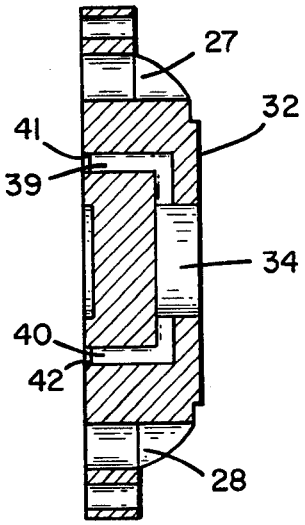
FIG. 6C shows a cross section view taken along the lines 6C—6C of FIG. 6A.
Figure 6B:
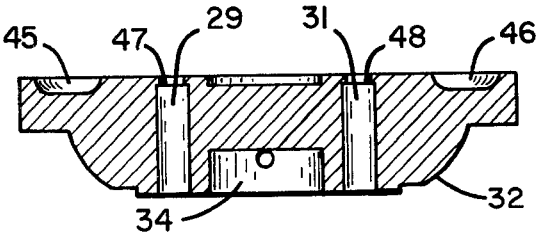
FIG. 6B shows a cross section view taken along the lines 6B—6B of FIG. 6A.

FIG. 6A shows a top view of pressure plate 32. Passages 27 and 28 form the main pressure passages between the pumping chamber 21 and primary discharge chamber 25. Arcuate grooves or slots 41 and 42 communicate with passages 39 and 40 respectively. Arcuate grooves 45 and 46 form intake cavities in the pumping chamber during the intake phase of rotor position. Arcuate grooves 47 and 48 form shallow segmented grooves to aid in distribution of liquid from passages 29 and 31. FIG. 6B shows a cross-sectional view of pressure plate 32 taken along the line 6B—6B of FIG. 6A. Passages 29 and 31 are drilled through to the bottom side of pressure plate 32, and therefore provide a flow communication path between discharge chamber 25 and arcuate grooves 47 and 48. Arcuate grooves 47 and 48 are in flow communication with the inner radial ends of the vanes that sweep past the arcuate angle defined by grooves 47 and 48 during the intake phase of rotor position. FIG. 6C shows a cross-sectional view of pressure plate 32 taken along the lines 6C—6C of FIG. 6A. Passages 39 and 40 are in flow communication through a cross passage, which in turn communicates with secondary discharge chamber 34. Passages 39 and 40 are also in flow communication respectively with arcuate grooves 41 and 42, and are therefore in flow communication with the inner radial ends of the vanes as they sweep past the angle subtended by arcuate grooves 41 and 42 during the pressure discharge phase of rotor rotation. In summary, the grooves and passages in pressure plate 32 provide a pressurized liquid flow path from the discharge chamber to the inner vane ends during the intake phase of rotation, which pressurized liquid acts to create a radially outward force against the vanes; during the pressure discharge phase of rotor rotation the inward radial movement of the vanes causes delivery of pressurized liquid via the grooves and passages to the secondary discharge chamber of pressure plate 32. In this manner, pressurized liquid is relieved from the inner radius ends of the vanes during the pressure discharge portion of rotor rotation, by feeding it into a secondary discharge outlet which may be utilized as a secondary pressure outlet from the pump. The source of liquid for this secondary pressure outlet is the discharge chamber forming a part of the primary pressure discharge of the pump. The volume of liquid which flows to the secondary pressure outlet is considerably less than the volume of liquid flowing from the primary pressure outlet, as may be seen from the relative sizes of the flow passages herein described. Thus, the pressurized liquid flow through the secondary outlet provides relatively low degradation and bleed off from the primary liquid outlet.

Figure 4:
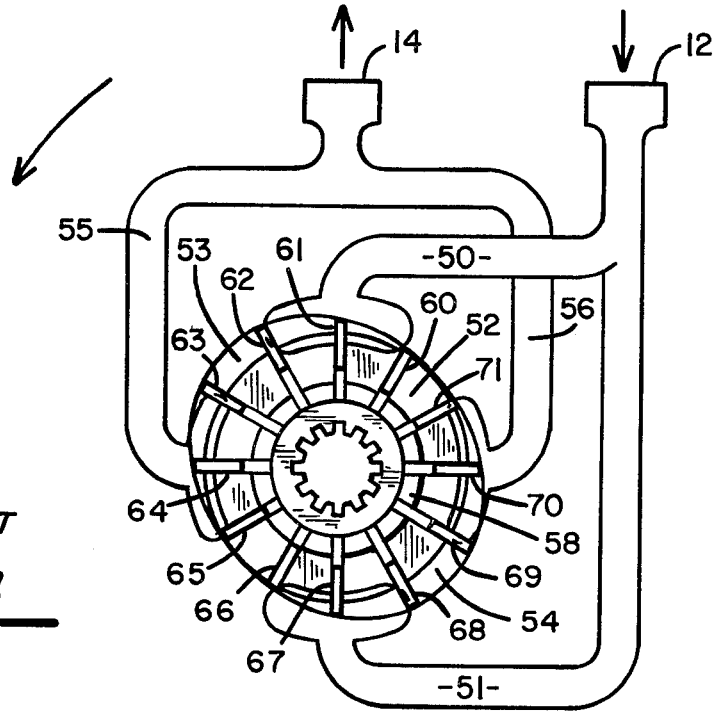
PRIOR ART Fig. 4
FIG. 4 shows a symbolic diagram of the operation of a conventional rotary vane pump.

FIG. 4 shows a symbolic diagram illustrating the construction of a conventional rotary vane pump. The overall principles of operation of this pump are similar to the pump of the present invention, with the exception that the secondary outlet is not present. A pair of inlet passages 50, 51 communicate with the pumping chambers 53, 54 respectively, which pumping chambers are formed by the elliptical shape of the contour surrounding the rotor 52. A plurality of vanes 60, 61, 62 . . . 71, are equally spaced about rotor 52 and are radially slidable in slots in rotor 52. A pair of outlet passages 55, 56 are in flow communication with portions of pumping chambers 53, 54.

As rotor 52 is engaged in the direction of rotation shown by the arrow, the vanes are centrifugally forced outwardly into sliding contact with the contour of the pumping chambers. The volume between adjacent vanes entraps a quantity of liquid, and this quantity of liquid is moved rotationally along with the vanes. As the vanes move past an inlet, such as vanes 61, 62 moving past inlet passage 50, they tend to create an opening of increasing size with rotational angle. This increasing-volume opening acts as a suction volume, drawing liquid from the inlet into the volume between vanes 61 and 62. The volume of liquid entrapped between adjacent vanes is increased until the rotor brings the vanes to the position shown for vanes 62, 63, wherein the maximum amount of liquid has been entrapped and vane 63 is beginning to be forced radially inward by the decreasing elliptical contour of the pumping chamber 53. This decreasing volume acts to build up liquid pressure for the volume of liquid entrapped between the adjacent vanes 62, 63, and this pressurized liquid is ultimately coupled into outlet passage 55 for flow communication with an outlet from the pump. When the rotor has moved to a position as shown by vane 65, a segment of chamber contour is traversed wherein no liquid may be entrapped between adjacent vanes. Shortly thereafter, the vanes once again encounter a region of contour of increasing elliptical size and the cycle is repeated. In the example shown, two elliptical pumping chamber sections are illustrated, although rotary vane pumps may be constructed with greater or lesser numbers of chamber sections depending upon particular applications.

Considering the operation of the individual vanes, is can be seen that any particular vane will radially move relative to the radial direction of its slot, depending upon the contour of the pumping chamber at any given instant. Thus, vane 60 is shown at a radially inwardmost position, and vane 62 is shown at a radially outward position. In conventional rotary vane pumps, it is typical to provide passages from the pressurized outlet of the pump back to the inside radii of the respective vane slot ends. During the intake phase of rotor position such pressurized liquid directed at the inner ends of the vanes serves to assist in forcing the vanes outwardly against the chamber contour, thereby improving the liquid seal which may be found between the vane end and the chamber contour. During the pressure discharge phase of rotation of the rotor the vanes are forced back inwardly and the pressurized liquid found along the inner radius of the vane slots is forced into the discharge chamber to be included with the discharge liquid. Suitable passages and bleed holes are provided, usually in conjunction with arcuate slots or grooves along the inner vane circumference 58, to ensure flow communication between the discharge chamber and the respective vane slots at all points of rotation.

Figure 5:
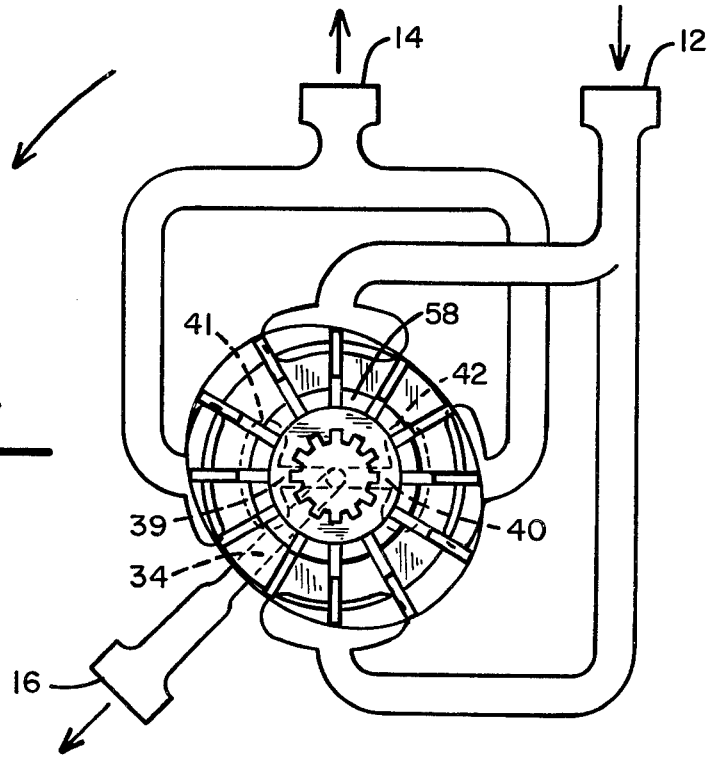
FIG. 5 shows a symbolic diagram of the operation of the invention.

FIG. 5 shows a symbolic diagram illustrating the construction of the present invention, as an improvement in rotary vane pumps of the type known in the prior art. Reference numbers of FIG. 5 are identical to the previous disclosure herein to the extent identical or similar features are shown. The description of the operation of FIG. 5 is identical, both in construction and operational details, as that of FIG. 4, with the exception of the following. The bleed holes and/or passages provided between the discharge chamber and the respective vane slots during the respective pressure discharge phases of rotor rotation are eliminated. Instead, grooves 41 and 42 are constructed between the slots along the inner vane radii 58 associated with the pressure discharge phase of rotor position to common passages 39 and 40. Passages 39 and 40 are connected to a passage which connects to secondary outlet 34. These arcuate grooves 41 and 42 provide a liquid flow path from the inner vane slots associated with the pressure discharge phase of operation to passages 39 and 40, chamber 34, and secondary outlet 16.

An alternative form of the invention may be provided in rotary vane pumps wherein the pressure plate or cheek plate is not an independent structural member, but is formed as a part of either the pumping chamber casting or the discharge chamber casting. The inventive principles described herein are equally applicable to pumps of this construction.

A further alternative form of the invention may be provided by expanding or contracting the arcuate length of the slots and passages described herein, with respect to the flow coupling of liquid from the inner vane radii to auxiliary discharge chambers. The inventive scope of the present invention will permit flow coupling of any one or more vane passages with one or more auxiliary pressure outlets, and therefore multiple auxiliary pressure outlets may be provided for certain applications.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a rotary vane pump of the type having radially slidable vanes in a rotor, said vanes being urged against an eccentric chamber around said rotor and being forced outwardly during an intake phase of rotation by liquid pressure coupled to the inner vane ends through first passages through a floating cheek plate coupled to a discharge chamber during said intake phase, the improvement in secondary pump pressure outlets during a pressure discharge phase of rotor rotation comprising (a) at least one secondary passage in said cheek plate positioned to flow communicate with a plurality of said inner vane ends during said pressure discharge phase;

(b) a secondary liquid conduit tube passing through said discharge chamber in said pump connected to said secondary passage in said cheek plate; and (c) a secondary outlet on said pump connected to said secondary liquid conduit tube.

2. The improvement of claim 1, further comprising a compression spring in said discharge chamber urging said cheek plate toward said rotor.

3. The improvement of claim 1, further comprising O-rings in liquid sealing relationship about said secondary liquid conduit tube.

4. In a rotary vane liquid pump of the type having a rotatable rotor in an eccentric chamber, the rotor having movable vanes disposed in radial slots therein, the vanes being radially outwardly movable in said slots during a suction portion of said rotor rotation and radially inwardly movable in said slots during a pressure portion of said rotor rotation, the pump having a liquid inlet in flow communication with said eccentric chamber proximate the outer radii of said slots at rotor rotational positions corresponding to said suction portion, the pump having a pressure outlet chamber and having a cheek plate with a first surface facing said eccentric chamber and a second surface facing said pressure outlet chamber, and the pump having a liquid outlet in flow communication with said pressure outlet chamber, and the pump pressure outlet chamber also being in flow communication with said vanes proximate the inner radii of said slots at rotor rotational positions corresponding to said suction portion through first passages through said cheek plate, the improvement in an auxiliary liquid pressure outlet from said pump comprising second passages in said cheek plate in flow communication with a plurality of said vanes proximate the inner radii of said slots at rotor rotational positions corresponding to said pressure portion and in flow communication through said cheek plate second surface, a liquid conduit tube coupled to said second passages and extending through said pressure outlet chamber, and an auxiliary outlet in flow communication with said liquid conduit tube and being capable of delivering separate pressurized liquid flow from said pump.

5. The improvement of claim 4, wherein said second passages further comprise a recess in said cheek plate bridging at least two of said radial slots.

6. The improvement of claim 5, further comprising spring biasing means in said pressure outlet chamber for urging said cheek plate toward said rotor.

* * * * *